US005345778A

United States Patent [19]

Roberts

[11] Patent Number: 5,345,778

[45] Date of Patent: Sep. 13, 1994

[54] LOW TEMPERATURE DISPLAY MERCHANDISER

[75] Inventor: Harold L. Roberts, St. Peters, Mo.

[73] Assignee: Hussmann Corporation, Bridgeton, Mo.

[21] Appl. No.: 60,154

[22] Filed: May 7, 1993

[51] Int. Cl.[5] ..... A47F 3/04

[52] U.S. Cl. ..... 62/256; 62/524

[58] Field of Search ..... 62/256, 524; 454/188, 454/193

[56] References Cited

U.S. PATENT DOCUMENTS

| | | | |
|---|---|---|---|
| 2,157,145 | 5/1939 | Ridge | 62/524 X |
| 2,836,039 | 5/1958 | Weber | 62/256 |
| 3,063,256 | 11/1962 | Lamb | 62/256 |
| 3,139,738 | 7/1964 | Jarvis | 62/256 |
| 3,289,432 | 12/1966 | Brennan et al. | 62/256 |
| 3,365,908 | 1/1968 | MacMaster | 62/256 |
| 3,369,375 | 2/1968 | Gerweck et al. | 62/256 |
| 3,392,544 | 7/1968 | Perez | 62/256 |
| 5,138,843 | 8/1992 | Tamayama et al. | 62/256 X |

*Primary Examiner*—William E. Tapolcai
*Attorney, Agent, or Firm*—Richard G. Heywood

[57] ABSTRACT

A low temperature food merchandiser having a cabinet with an open front product area, a primary cold air system for maintaining substantially constant low temperatures of at least 0° F. in the product area including the formation of plural primary low temperature air curtains across the open front, a secondary air system protecting the primary air curtains, and the primary system also including primary evaporator cooling means constructed and arranged to operate at elevated coil temperatures in the range of −5° F. to −2° F. to maintain the 0° F. product area temperature, and including reverse air cycle defrost means for periodically defrosting the primary cooling means.

16 Claims, 5 Drawing Sheets

LOW TEMPERATURE DISPLAY MERCHANDISER

BACKGROUND OF THE INVENTION (a) Field of the Invention

This invention relates generally to the commercial refrigeration art, and more particularly to improvements in product merchandisers especially designed for the low temperature refrigeration of frozen food products.

(b) Description of Prior Art

Since about 1960 the commercial refrigeration industry has developed many food merchandisers having open front product display zones for the display and merchandising of frozen food products. Examples of such prior art configurations utilizing ducted air flow and multiple air curtain control include the following patents:

| U.S. Pat. No. | Date | Inventor |
|---|---|---|
| 2,794,325 | June 4, 1957 | Shearer |
| 2,836,039 | May 27, 1958 | Weber |
| 2,855,762 | Oct. 14, 1958 | Zehnder |
| 2,862,369 | Dec. 2, 1958 | Simons |
| 2,890,573 | June 16, 1959 | Lamb |
| 2,936,596 | May 17, 1960 | Rainwater |
| 2,952,992 | Sept. 20, 1960 | Voorhies |
| 2,962,875 | Dec. 6, 1960 | Barroero |
| 3,010,379 | Nov. 28, 1961 | Arzberger et al |
| 3,063,252 | Nov. 13, 1962 | Lamb |
| 3,063,253 | Nov. 13, 1962 | Dickson et al |
| 3,063,254 | Nov. 13, 1962 | Dickson et al |
| 3,063,255 | Nov. 13, 1962 | Fanick et al |
| 3,094,851 | June 25, 1963 | Beckwith |
| 3,122,892 | Mar. 3, 1964 | Beckwith |
| 3,186,185 | June 1, 1965 | Bently et al |
| 3,218,822 | Nov. 23, 1965 | Bently et al |
| 3,287,929 | Nov. 29, 1966 | Beckwith |
| 3,289,432 | Dec. 6, 1966 | Brennan et al |
| 3,365,908 | Jan. 30, 1968 | MacMaster |
| 3,369,375 | Feb. 20, 1968 | Gerweck et al |
| 3,392,544 | July 16, 1968 | Perez |
| 3,420,070 | Jan. 7, 1969 | Hermanson |
| 3,517,526 | June 30, 1970 | MacMaster et al |
| 3,850,003 | Nov. 26, 1974 | Beckwith et al |
| 4,026,121 | May 31, 1977 | Aokage |
| 4,144,720 | Mar. 20, 1979 | Subera et al |
| 4,265,092 | May 5, 1981 | Abraham |
| 4,302,946 | Dec. 1, 1981 | Ibrahim |
| 4,314,453 | Feb. 9, 1982 | Abraham |
| 4,648,247 | Mar. 10, 1987 | Takazawa et al |
| 4,964,281 | Oct. 23, 1990 | Tanaka |
| 5,048,303 | Sept. 17, 1991 | Campbell et al |
| 5,138,843 | Aug. 18, 1992 | Tamayama et al |

All frozen food merchandisers are designed with the primary objective of maintaining product temperatures in the display area at about 0° F. for frozen food and about −10° F. for ice cream, which in the past has required evaporator coil temperatures in the range of −10° F. down to −35° F. At lower coil temperatures, ice buildup on the evaporator coils is accelerated, and thus the frequency and/or duration time of coil defrosts has been higher with the result that defrost heat usually produces increases in product zone temperatures. Furthermore, the inefficiency of prior art open front frozen food display cases has resulted in high energy consumption requirements. Thus, the large energy costs coupled with the inherent problems of maintaining proper product temperatures for good quality shelf life resulted in a marketing trend to closed, glass front reach-in merchandisers.

SUMMARY OF THE INVENTION

The invention is embodied in a low temperature food merchandiser having a cabinet with an open front product area, a primary cold air system for maintaining substantially constant low temperatures of at least 0° F. in the product area including the formation of plural primary low temperature air curtains across the open front, a secondary air system protecting the primary air curtains, and the primary system also including primary evaporator cooling means constructed and arranged to operate at elevated coil temperatures in the range of −5° F. to −2° F. to maintain the 0° F. product area temperature and including reverse air cycle defrost means for periodically defrosting the primary cooling means.

A principal object of the present invention is to provide a low temperature open front food merchandiser in which optimum product temperatures are maintained with elevated coil operating temperatures and minimum icing conditions.

Another object is to provide an open front merchandiser having a primary low temperature air system having a plurality of discrete shelf display zones protected by the discharge of separate air curtains.

Another object is to provide a multideck, open front, merchandiser having a low temperature refrigeration cycle and a reverse air flow defrost cycle without any appreciable change in product temperature or impact on customer comfort.

Another object is to provide a multideck, open front, low temperature merchandiser that is efficient in operation and affords substantial energy consumption savings in the order of 30% to 40% relative to comparable sized prior merchandisers.

Another object is provide an open front, multideck frozen product merchandiser having a wide range of display shelf flexibility in adjustment or removal.

Another object is to provide a low temperature merchandiser having maximum cooling capacity and product display cube with a narrow footprint occupying minimum floor space in the shopping arena.

Another object is to provide a frozen product merchandiser affording improvements in product display with a variable capacity lower well, shelf adjustment and light modulation.

Another object is to provide a merchandiser with a highly efficient low temperature refrigeration system and primary air distribution network.

These and other objects and advantages will become apparent hereinafter.

DESCRIPTION OF THE DRAWINGS

In the accompanying drawings which form a part of this specification and wherein like numerals refer to like parts wherever they occur.

DESCRIPTION OF THE PREFERRED EMBODIMENT

Figure 1:
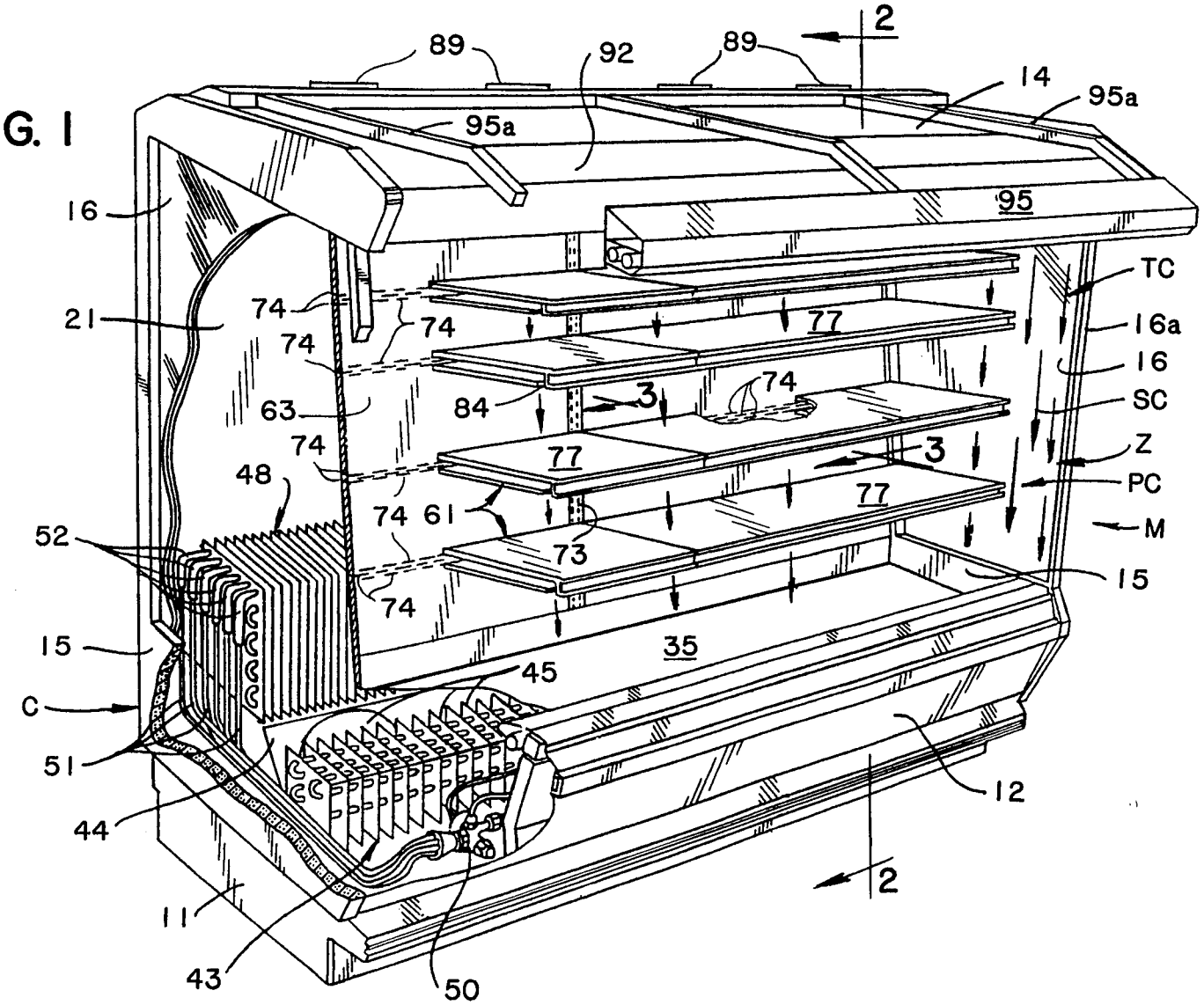
FIG. 1 is a perspective view of an open front, low temperature merchandiser embodying the invention and partly broken away to show a portion of the low temperature primary cooling system.

The present invention constitutes improvements in open front, low temperature, multideck product display merchandisers M having an outer cabinet C with a vertical, open front, product display zone Z cooled to its predetermined low temperature condition by a primary air system P and which is further protected by a secondary air system S and a tertiary air system T. As used herein, "low temperature" has reference to frozen food product temperatures of 0° F. and ice cream product temperatures of −10° F. except as may otherwise be specifically described.

Referring now to the drawings, the cabinet C of the merchandiser M of the present invention includes an insulated outer cabinet having a base 11, a low front wall 12, a high rear wall 13, a top wall 14 extending forwardly from the rear wall 13 and end walls 15 including forwardly extending three-pane thermal glass panels 16 with front trim strips 16*a*. The front of the frozen food merchandiser M is open between the top of the front wall 12 and the front of the top wall 14 for direct accessibility to the interior product zone Z of the merchandiser.

Positioned within the outer cabinet and extending longitudinally between the end walls 15 is an intermediate cabinet liner which includes a bottom wall Or panel 17 in spaced relation with the base 11 to provide a bottom outer air flue or duct 18, a front or panel wall 19 spaced from the front wall 12 to provide a front flue or return duct 20 in communication with the bottom flue 18 as part of the secondary system S, an insulated rear duct or wall 21 spaced from the back or rear wall 13 to provide a rear duct or flue 22 also in communication with the bottom flue 18, and an insulated top wall or panel 23 spaced below the outer top wall 14 and defining an air distribution chamber 24 of the secondary air system S. The forward end of the top or upper wall 23 has a projecting front member 25 extending away from the top wall 14, and the top wall 14 of the outer cabinet also has a short depending vertical front wall 27 extending downwardly therefrom in forward spaced relation with the front wall member 25 to form a front discharge area or chamber 28 at the front of the chamber 24 of the secondary system S. A relatively wide horizontal section of honeycomb material 29 is constructed and arranged to bridge across or span the front walls 25 and 27 and form the vertical air discharge means through which non-refrigerated air of the secondary system S is discharged, as will be described more fully. The wall 23 slopes upwardly from the rear panel 21, and the rearward portion of the chamber 24 houses a fan 30 or other air circulating means. The chamber 24 is divided in the usual way by a partition 31 extending linearly the length of the cabinet between the rear wall 13 and the top wall 23 and having spaced openings 32 in which the fan blades 33 of plural fans 30 are mounted for efficiently moving air through the entire outer flue network of the secondary system S and in a vertical air curtain SC across the open front of the merchandiser to the return duct 20. It will be seen that the chamber 24 is defined by the forwardly narrowing or converging walls 14 and 23, and that another air control partition or baffle 34 is positioned immediately adjacent to the discharge honeycomb or air straightening means to define a tapering air delivery throat 28 for pressurizing and evening air flow distribution longitudinally and laterally of the honeycomb 29. Thus, the return duct or flue 20, bottom and rear flues 18 and 22, upper chamber 24 and discharge area and member 28, 28*a*, 29 form an air circulatory system for continuously recirculating non-refrigerated air. This secondary system S does not directly cool food products in the display area Z, but forms a protective air wall both during normal refrigeration and defrost cycles of the primary system P. The fans 30 create a negative pressure through the rear, bottom and front flues to draw air curtain air into the front flue 20 and to continuously recirculate the air of the secondary system S in maintaining the secondary air curtain SC discharged downwardly across the merchandiser M.

The merchandiser M also includes an innermost cabinet defining the display area Z in which frozen food products are placed for refrigerated merchandising. The inner cabinet also extends linearly the longitudinal extent between the end walls 15, 16 of the outer cabinet, and includes an insulated bottom panel or wall 35 spaced above the bottom wall 17 of the intermediate cabinet to form a lower or front refrigeration chamber 36. An insulated front panel 37 is spaced from the front wall 19 of the intermediate cabinet and provides a cold air return flue or duct 38 of the primary air system P therebetween, the panel 37 having an angularly-positioned perforated plate 39 secured to the front wall 19 and forming the return inlet for the front flue 38. The inner cabinet also includes a lower rear panel 41 spaced forwardly from the rear wall 21 of the intermediate cabinet and defining a main rear refrigeration chamber 42 therebetween.

The return flue 38 is in communication with the front refrigeration chamber 36, which houses a front evaporator coil section 43 extending the longitudinal length of the merchandiser M. The refrigeration chamber 38 is divided by an angular partition 44 having longitudinally spaced openings 45 for fan blades 46 of fans 47 or like air circulating means. The main rear chamber 42 is in open air flow communication with the front refrigeration chamber 36 and coil 43 through the fan openings 45, and the rear refrigeration chamber 42 houses the full length main evaporator coil section 48 through which primary air is moved by the fans 47. The coil sections 43 and 48 are part of a commercial closed refrigeration system (not shown) that does not form a part of the invention except as to the refrigerant distribution and coil defrost cycles to be described.

Figure 2:
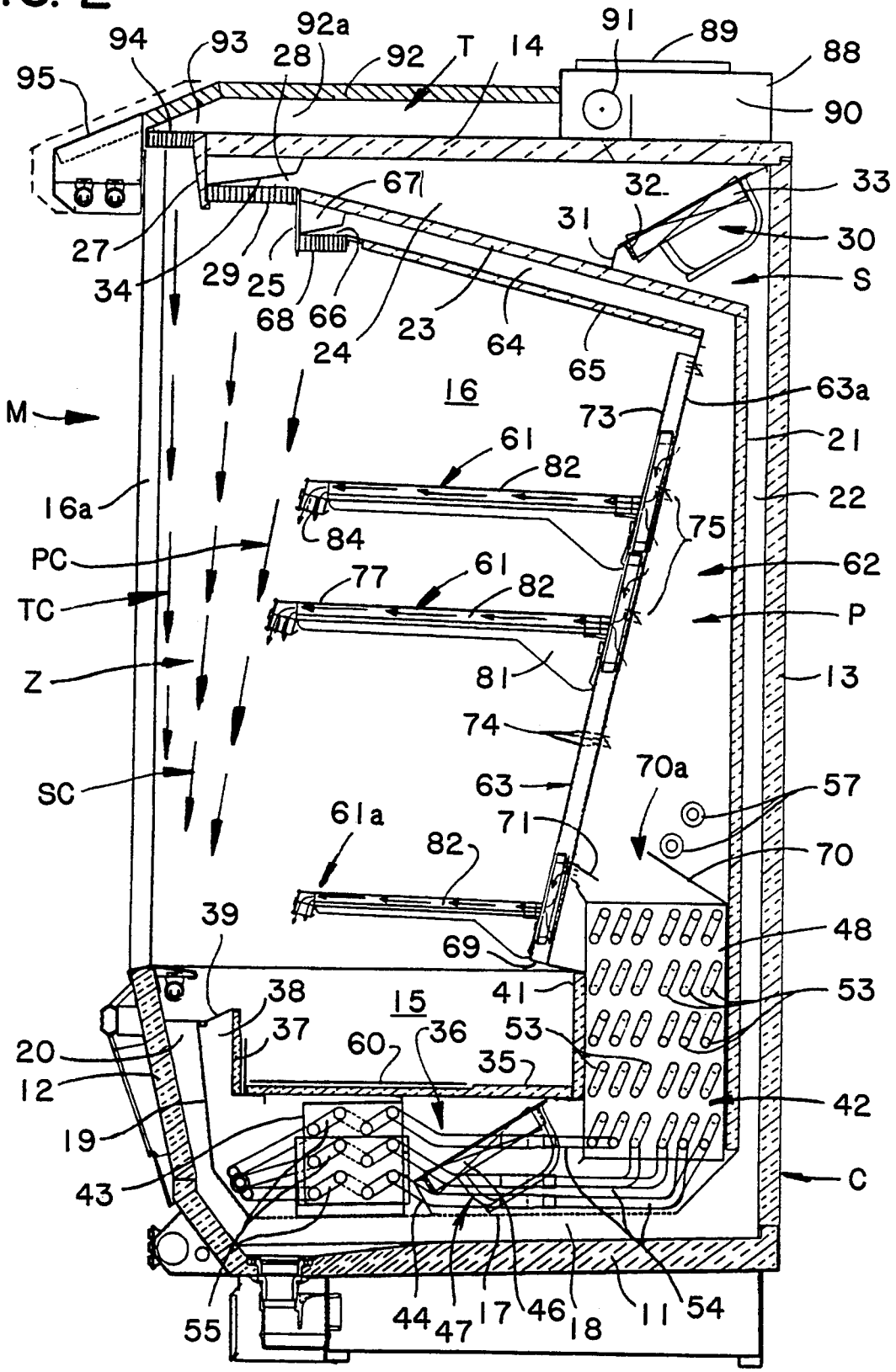
FIG. 2 is a vertical cross-sectional view of the merchandiser as taken substantially along line 2—2 of FIG. 1.
Figure 5:
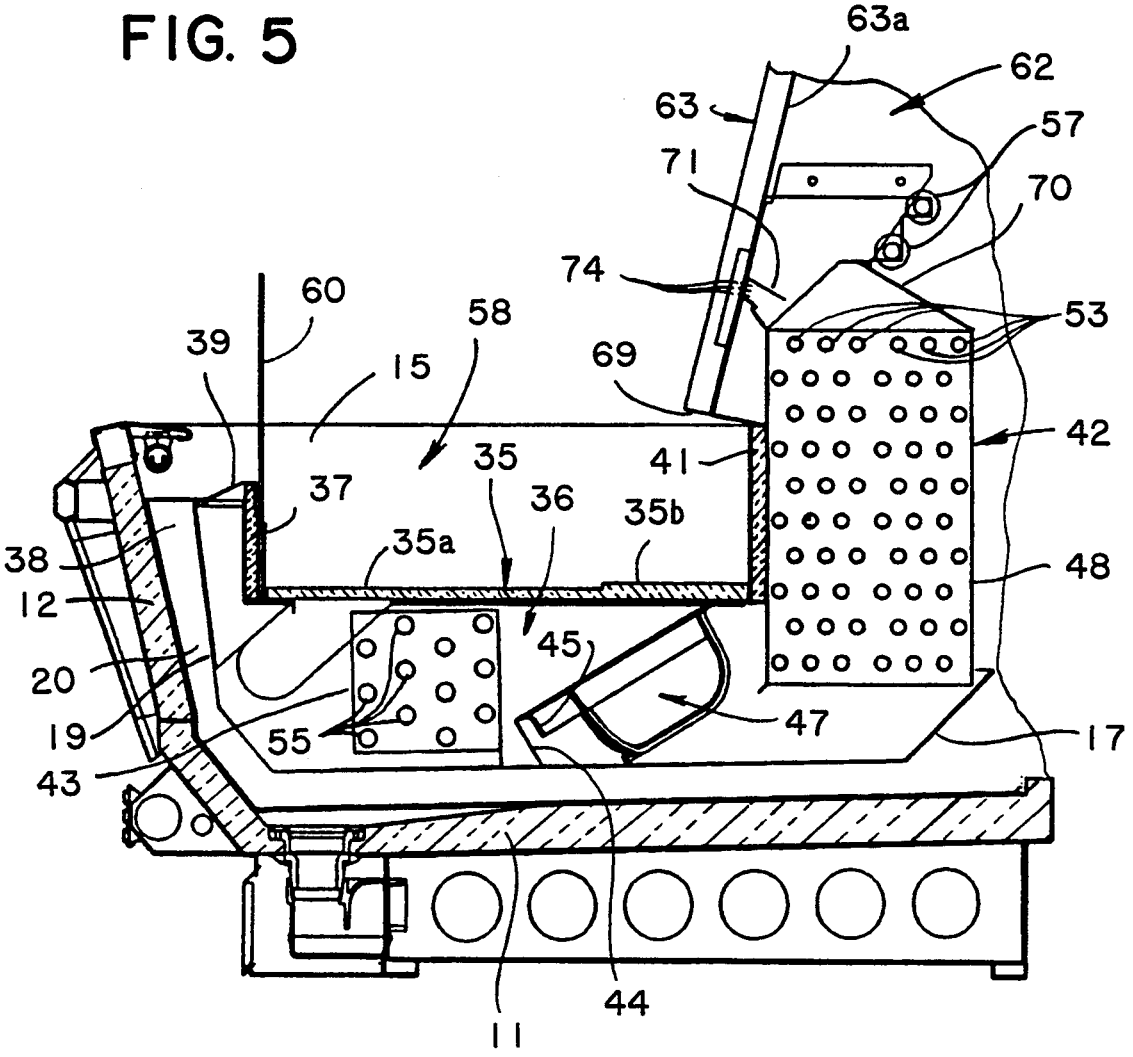
FIG. 5 is a greatly enlarged fragmentary and partially diagrammatic cross-sectional view, similar to FIG. 2, and showing another portion of the primary cooling system, and also illustrating a foldable product zone wall.

Still referring to FIG. 2, it is clearly shown that the front and rear chambers 36 and 42 form an L-shaped main refrigeration chamber positioned at the bottom and rear of the cabinet and having inlet and outlet ends as part of the primary refrigerated air system P with the normal air flow circulation being downwardly in the front flue 38 and across the front coil section 43 and upwardly through the rear coil section 48. As seen in FIGS. 1, 2 and 5, the refrigeration system liquid line (not shown) is brought into the base of the merchandiser cabinet in a conventional way and connects to a conventional thermostatic expansion valve 50 or the like. The expansion valve 50 is piped by six parallel coil runs or circuits 51 of substantially equal length extending across one end of the chambers 36 and 42 and connecting with the upper coil inlet tubes 52 to each of six vertical circuits 53 through the rear main coil 48. Refrigerant flow is first distributed to the upper coil tubing of the rear coil 48 from the expansion valve 50, which thus will be the coldest zone of the main system and which is also the area of primary air discharge upwardly and outwardly of the main coil section 48 for distribution to cool the product zone Z. Refrigerant flow is downwardly in the rear coil 48 in reverse flow to the direction of primary air movement through the coil during the refrigeration cycle. The six separate vertical coil circuits 53 are connected in pairs at the bottom of the rear coil to three horizontal refrigerant circuits 54 which connect to three corresponding coil circuits 55 of the front coil 43, which in turn are connected to a suction line take-off in a usual manner for returning expanded vaporized refrigerant to the refrigeration system compressors (not shown). The conduit size of the six distribution circuits 51 and rear coil tubes 53 is relatively smaller than the conduit size of the three connection circuits 54 and front coil tubes 55 to eliminate pressure drop in the evaporator coils except as typically controlled through the entire circuitry from the expansion valve 50. For instance, the six delivery circuits 51 and rear coil tubing 53 may be sized at $\frac{5}{8}$ inch, and the three connection circuits 54 and front coil tubing 55 may be sized at $\frac{3}{4}$ inch. Thus, refrigeration cooling means for the primary air system P produces the coldest coil temperatures in the range of −5° F. to −2° F. at the point of primary air discharge, and the slightly warmer coil temperatures will prevail at the return air lead-in to the front coil 43. It will be clear that the evaporator coils 43 and 48 are of the fin and tube type, and the fin spacing (longitudinally of the merchandiser M) of the front coil 43 is wider than the fin spacing of the rear coil 48 so that the front coil functions primarily as a "frost catcher" to initially pre-cool recirculated air curtain air from the open front of the display area Z and start to remove its moisture content in the form of ice on the fins without bridging across and blocking primary air flow through this coil section. The counterflow refrigerant distribution in the coil sections 48 to 43 (relative to the direction of air flow) results in substantially even ice or frost build up on the fins and more even air distribution longitudinally in the air system channels.

The presently preferred form of defrost of the main refrigeration coils 43 and 48 is by electrical defrost, and a pair of horizontally and longitudinally extending Calrod defrost heaters 57 are disposed vertically above the rear coil 48. A defrost cycle is carried out by reverse air flow operation of the primary fans 47 in the primary system P to bring the heat downwardly through the rear coil 48 then forwardly through the front coil 43. The efficiency of the present merchandiser is designed to reduce the number of defrost cycles and to shorten the defrost duration typically from about 40 minutes heretofore to about 15 to 20 minutes. It will be understood that hot gas defrost or latent heat defrost may be employed in lieu of electric heat defrost, as will be readily apparent to those skilled in the art. In the case of gas defrost, the primary air circulation is still reversed and the defrost duration will be about 10 to 15 minutes.

It is now apparent that, in the normal refrigeration cycle, air is drawn into the return flue 38 by the negative pressure developed by the fans 47 and passed through the coils 43, and is then forced upwardly through the rear coils 48 where the air is fully refrigerated to the elevated low coil temperatures of −5° F. to −2° F. required for maintaining food products in frozen condition at 0° F. "Elevated low coil temperature" herein means that the multideck, open front merchandiser M and its primary air refrigeration and circulation system P are constructed and arranged to keep the product zone Z and food products therein at the designated frozen food temperature of 0° F. or −20° F. while operating at a temperature of only a few degrees colder—as contrasted with conventional prior merchandisers that generally operate at coil temperatures of about −10° F. It is known that each degree of lower coil temperature results in more moisture removal and icing in the coil which by itself results in lost refrigeration capacity, additional or longer defrosts and high product temperatures above 0° F. In the present invention the main coil size is increased about 25% to 40% in order to achieve more efficient refrigeration and better air control.

The bottom panel 35 and front and rear panels 37 and 41 of the inner cabinet liner and the end walls 15 of the outer cabinet define a lower well 58 of the display area Z in which food products may be placed. As shown best in FIG. 5, the front part **35*a* of the bottom panel 35, extending a substantial distance back from the vertical front panel 37, is thinner than the rearward portion 35*b* to accommodate a movable glass shelf panel 60. This panel 60 is hinged at its longitudinal forward margin for upward swinging movement from a horizontal shelf-forming position in which the panel 60 lies in the recessed thinner area 35*a* of the bottom panel 35 (FIG. 2) and a vertical wall-forming position in which the panel 60 extends upwardly parallel to the front panel 37, but above the lower front wall 12 and lower part of end wall 15 (FIG. 5). In this way the area of the well 58 can be substantially deepened for certain merchandising purposes, and the glass panel affords full visibility. It will be clear that the merchandiser M is of the multideck-type having a plurality of vertically spaced horizontally extending shelves 61 in the upper portion of the product display zone Z, but that the shorter lower shelf 61*a* normally accommodating access to the shallow well configuration of FIG. 2** is removed in order to raise the shelf panel to its front wall forming position.

The primary air refrigeration and distribution system P is designed to maintain optimum product temperatures with a minimum change from the operating coil temperatures (e.g., a change of about 2° to 5°). Primary air is discharged upwardly in the rear chamber 42 through the main rear coil section 48 and into a rear air distribution flue or duct 62 that is vertically disposed between the intermediate insulated rear wall 21 and a sloping front panel 63, which also forms the rear or back wall of the upper display area Z. The primary air distribution system P has a top flue or duct 64 delineated by an insulated top panel or wall 65, which extends forwardly from the rear duct 62 and terminates at a tapering front discharge chamber 66 defined, in part, by an air control baffle 67 connected between the depending wall 25 and the insulated top wall 23 of the intermediate cabinet to back-pressure primary air and even out its longitudinal distribution for discharge through an air straightening honeycomb 68 or the like to form a primary air curtain PC of low temperature air across the open front of the display area Z.

The lower end 69 of the upper rear panel 63 connects to the upper end of the lower rear panel 41 below the upper air discharge end of the rear coil 48. A primary air control baffle 70 projects angularly from the panel 21 to direct air flow from the coil 48 forwardly as well as upwardly into the wide bottom area of the rear duct 62, and another angular baffle 71 connects to the opposed surface of the rear panel wall 63 to project angularly downwardly toward the leading air discharge edge of the coil 48 and substantially parallel with the rear panel baffle 70 to define an air proportioning throat or control means 70*a*.

The upper rear panel 63 is spaced from the rear panel 21 of the intermediate cabinet by suitable means including a center divider wall and shelf support 73 disposed vertically between the end walls 15 and dividing the rear cold air delivery flue or duct 62 into at least two sections. The rear panel 63 is provided with a plural series of air outlet openings or moire 74, and upper series of moire for the upper shelves 61 each have a baffle 75 positioned to extend into the rear duct 62 and deflect a portion of the primary air stream through the moire for delivery to the hollow shelves 61 as part of the primary air system P. As shown best in FIGS. 3 and 4, the shelves 61 are adjustably mounted on the rear wall 63 and extend forwardly therefrom into the upper portion of the display area Z. The shelf support stanchions 73 are formed on the center wall divider 73 and at each end of the display area to adjustably support the shelves 61 within a predetermined vertical range defined by the location of the moire 74 and shelf sealing means 76 to be described.

Figure 3:
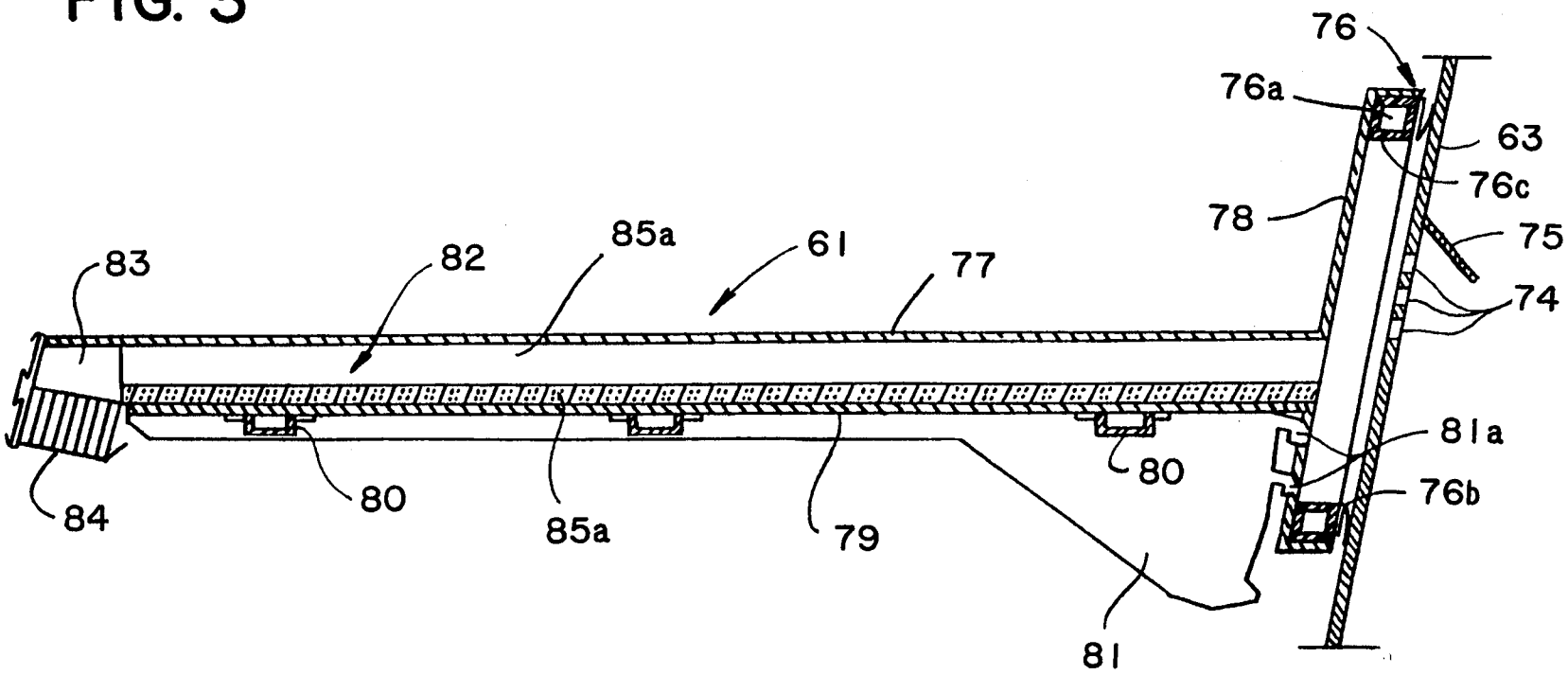
FIG. 3 is a greatly enlarged fragmentary cross-sectional view of a product area shelf forming a portion of the primary air distribution system.

In FIG. 3 it will be seen that each shelf 61 has a horizontal shelf plate or deck 77 with a back plate 78 secured at an angle to accommodate the slope of the rear panel 63. The shelf 61 also has a bottom metal panel 79 in spaced relation with the upper panel 77, and it is reinforced with longitudinal structural hat sections or members 80 to support substantial product weights on the shelf. The usual shelf mounting brackets 81 with bayonet tabs 81*a* are provided for adjustably mounting the shelf 61 on the shelf stanchions 78 at the center and ends of the merchandiser. The space between the upper and lower shelf plates or panels 77 and 79 is constructed and arranged to define an air delivery channel means 82 extending to a longitudinal discharge chamber 83 at the front of each shelf, and longitudinal honeycomb sections 84 are provided for air control from the discharge chamber 83 at each shelf level. However, it is to be understood that selective shelves 61 may be removed from the product zone Z without adversely affecting the operation of the merchandiser or the maintenance of low product temperatures therein.

Figure 4:
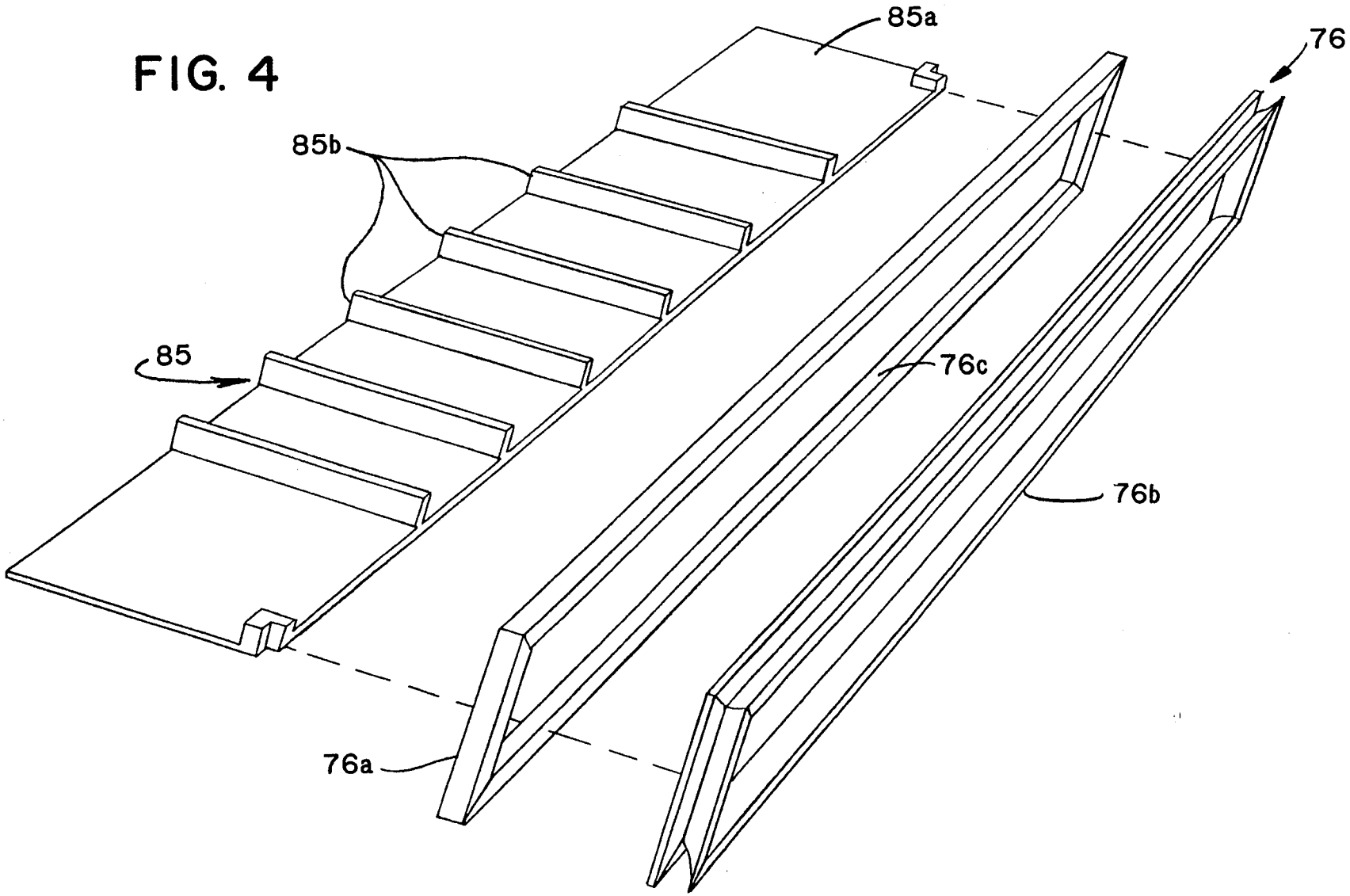
FIG. 4 is an exploded isometric view showing the foam core and seal of the shelf.

The space between the upper and lower shelf panels 77 and 79 accommodates an insulated foam shelf core 85 having a continuous bottom panel 85*a* with longitudinally spaced upstanding ribs 85*b* which extend the depth of the shelf 61 and define the channel or parallel air tunnel means 82 for conveying primary air from the moire inlets 74 to the shelf honeycomb 84 (see FIGS. 8 and 4). The shelves 61 sealably engage the panel 68 and, for that purpose, the back plate 78 of each shelf has the sealing means 76 attached to provide an air seal framing around the channel means 82. The sealing means 76 include extruded frame pieces or members 76*a* of rectangular cross-section assembled into a rectangular frame attached to the core member 85 or to the back plate 78 itself, and a resilient sealing member 76*b* is attached to or formed integral with the extruded frame pieces 76*a*. The shelf 61 is adjustable vertically within the confines of the air inlet opening or window 76*c* defined by the frame, and the seal member 76*b* is compressed into sealing engagement against the rear panel front surface 63 to maintain primary air flow from the primary rear duct 62 into the shelf tunnels 82 as diverted or proportioned by the baffles 71 and 75 through the moire openings 74. It will be noted that a removable strip of magnetic tape 86, FIG. 5, is applied to cover the moire section 74 whenever a shelf 61 is removed to prevent primary air leakage into the rear portion of the display zone Z next to the panel 63. It will also be noted that the top deck or plates 77 of the shelves 61 afford conductive cooling of the products placed thereon, but that the lower panel 79 is insulated by the bottom core wall 85*a* to obviate moisture migration and frost buildup under the shelves.

Referring again to FIG. 2, the tertiary air system T is an ambient air system mounted on the exterior of the main outer cabinet C. The tertiary system T includes a longitudinal air moving housing 88 attached to the back of the top wall 14 and having plural filtered air intake openings 89 in communication with a main intake chamber 90, which connects to plural blowers 91 preferably of the tangential type. The rear housing 88 and blower outlet therefrom connect to a forwardly extending air duct wall 92 defining the delivery duct 92*a* for conveying ambient air from the blowers 91 to the front of the merchandiser M. This duct tapers or is baffled to define a narrowing air discharge area 93, and an air control honeycomb 94 through which a tertiary air curtain TC of ambient air is formed across the open front outwardly of the secondary air curtain SC. The merchandiser M is also provided with an upper light canopy 95 that is constructed and arranged to illuminate the product zone Z, and may be telescopically or otherwise adjustable on struts 95*a* to be extended forwardly to modify the lighting effect.

In the operation of the merchandiser M, the primary system P, the secondary system S and the tertiary system T cooperate to provide the desired low temperatures in the display area Z for keeping food products in frozen condition and for providing an inner cold front or wall of low temperature air with a temperature gradient outwardly to ambient that obviates the necessity for doors or glass panels across the front of the merchandiser shelves 61. The glass retaining wall or barrier 60 is only turned up above the low front wall 12 of the outer cabinet as needed to enlarge the well volumetrically. The three air systems also reduce to a minimum the amount of ambient room temperature air that becomes entrained or intermixed with the low temperature air wall PC so that the merchandiser can operate efficiently and perform its function of maintaining low frozen food product temperatures. In addition, moisture is substantially eliminated from the display area Z and condensation, and consequent icing, is substantially reduced on the evaporator coils 43 and 48 of the primary system P.

In the operation of the primary system P, the main fans 47 draw cold air into the return duct 38 from the display area Z and through the front coil section 43, and then pushes this pre-cooled and dehumidified air upwardly through the large rear coil 48 in chamber 42 where the temperature of the air is reduced to the requisite optimum temperature, e.g., −3° F. for frozen food. The primary air stream forced through the coil 48 is diverted by rear flue baffle 70 and the major portion of the air passed upward in rear delivery duct 62. A small portion of the coil air is deflected downwardly by baffle 71 into the lower shelf duct 82 and other portions of air are diverted at each shelf level with the final air portion flowing forwardly and upwardly in upper duct 64 to the primary honeycomb 68. It will be seen that the rear duct 62 forms a long upward channel with converging walls 21 and 63. The air flow into each shelf duct 82 is uniform and substantially one-half of the volume of air flow delivered through the top duct 64 for downward discharge through the primary honeycomb 68 to form the low temperature air curtain PC. Thus, primary air is discharged at the front top 68 of the display area and at the front only of each shelf 61 to provide convection cooling of the display area of the next lower shelf without distribution of any air from the rear or intermediate shelf location, whereby by discharging the same temperature air at multiple vertical levels from top to bottom in the display zone, the temperature will be substantially constant throughout. The main fans 47 create a negative suction or return air velocity of about 600 fpm, and this air velocity is reduced at the rear discharge duct control throat 70*a* to about 300 fpm which is maintained during vertical air distribution by the tapering rear duct configuration.

The secondary system S has a discharge honeycomb of about twice the width as the primary system discharge 68 to provide a wide non-refrigerated air curtain SC, and the tertiary system T discharges a narrower width curtain TC similar to the primary air curtain PC. In the preferred embodiment disclosed, the ratio of the shelf air curtains to the primary curtain PC to the secondary system curtain SC to the tertiary curtain will be about 1:2:4:2. The curtain discharged at each successive shelf front contributes to the formation of widening primary curtain PC. The return air temperature of the primary system P at the return duct 38 will be substantially lower than prior art merchandisers.

During defrost, the normal refrigeration cycle of the primary system coils 48 and 43 is discontinued and the defrost means (e.g., electric or gas) is initiated along with a reversal of the primary fan direction to draw heated defrost air downwardly (from the Calrod heaters 57) through the rear and front coil sections 48 and 43 and upwardly in the front duct 38. This practice is well-known in the art. However, the secondary air system S and tertiary system T continue to function in their normal downward curtain formation to shield the product zone Z and to create at least a partial short circuit of primary discharge air from the grill 39 back downward into the secondary return flue 20. The defrost parameters are highly efficient and the duration of each defrost cycle has been shortened by about one-half, e.g., from about 40 minutes to 15 to 20 minutes for electric as previously described.

The present merchandiser is highly efficient in operation and provides a large accessible product display area Z for displaying frozen food products while occupying a minimum floor space. It is to be understood that the foregoing description and accompanying drawing have been given only by way of illustration and example, and that changes and modifications in the present disclosure, which will be readily apparent to all skilled in the art, are contemplated as within the scope of the present invention, which is limited only by the scope of appended claims.

What is claimed is:

1. A refrigerated merchandiser having a cabinet with an open front product display area, primary air system means including evaporator cooling means constructed and arranged for refrigerating primary air to low refrigeration temperatures and primary air circulating means for circulating the refrigerated primary air from said evaporator cooling means to maintain a substantially uniform low temperature throughout the display area, said primary system means including a plurality of vertically spaced shelves, each of said shelves having an upper product supporting deck and lower air channeling means, said air channeling means including an imperforate insulated bottom wall and a plurality of vertical ribs projecting upwardly therefrom and engaging said upper deck to define a plurality of elongated air tunnels constructed and arranged to channel low temperature primary air therethrough and to discharge such air therefrom downwardly in a series of shelf-to-shelf primary air curtains immediately adjacent to the open front of the display area as part of the primary air circulating means, the primary air circulating means also discharging at least one other primary air curtain downwardly from the top of the merchandiser across the open front of the display area outwardly of the shelf-to-shelf primary air curtains, the air flow of said primary air curtains being the only positive air movement in said display are, and at least one other air system means constructed and arranged for forming another air curtain across the open front of the display area outwardly of said primary air curtains.

2. The merchandiser of claim 1, in which said product supporting deck and said elongated tunnels are in conductive heat exchange relationship.

3. The merchandiser of claim 1, in which said elongated air tunnels extend across said shelf and form an air discharge chamber at the front edge of the air channeling means, and air straightening means constructed and arranged at said discharge chamber for forming one of said primary air curtains.

4. The merchandiser of claim 1, in which said display area has a rear panel forming a duct wall of the primary air circulating means, and said shelf being mounted to extend from said rear panel across the display area to the open front thereof, and air control means for distributing refrigerated primary air from the evaporator cooling means to the elongated air tunnels of said shelf as part of the circulating means.

5. The merchandiser of claim 4, in which said air control means comprises air passage means through the rear panel duct wall, and shelf sealing means constructed and arranged to sealably enclose the shelf air tunnels in air flow communication with the rear duct air passage means.

6. The merchandiser of claim 5, in which the air passage means of said rear panel has a predetermined vertical size and extends longitudinally across the rear panel, and said sealing means is carried on said shelf means in circumscribing relation with the air tunnels and sealably engages the rear panel above and below the air passage means.

7. The merchandiser of claim 6, in which said shelf includes a rear mounting plate means extending above the upper deck and below the insulated bottom wall, and said sealing means comprises an open rectangular frame secured on the back of the rear mounting plate means and a resilient seal mounted on said rectangular frame.

8. The merchandiser of claim 7, in which the rectangular frame extends above and below the air passage means, and said shelf is adapted for limited vertical adjustment to maintain the air passages within the opening of the rectangular frame.

9. The merchandiser of claim 5, in which said air control means further comprises baffle means constructed and arranged for proportioning the volume of primary air distributed through the rear panel air passage means to the shelf air tunnels.

10. The merchandiser of claim 9, in which said shelf is adapted for limited vertical adjustment on said rear duct wall.

11. A refrigerated merchandiser having a cabinet with an open front product display area, primary air system means including evaporator cooling means constructed and arranged for refrigerating primary air to low refrigeration temperatures and primary air circulating means for circulating the refrigerated primary air from said evaporator cooling means to maintain a substantially uniform low temperature throughout the display area, said display area including a lower well zone with a product supporting deck means, a portion of said deck means being a deck panel movable to a vertical front wall forming position, said primary system means including a plurality of vertically spaced shelves, each of which is constructed and arranged in said display area above the lower well zone to channel low temperature primary air therethrough and to discharge such air downwardly in a series of shelf-to-shelf primary air curtains immediately adjacent to the open front of the display area as part of the primary air circulating means, the primary air circulating means also discharging at least one other primary air curtain downwardly from the top of the merchandiser across the open front of the display area outwardly of the shelf-to-shelf primary air curtains, the air flow of said primary air curtains being the only positive air movement in said display area, and at least one other air system means constructed and arranged for forming another air curtain across the open front of the display area outwardly of said primary air curtains.

12. The merchandiser of claim 11, in which the movable portion of said deck panel means is a glass panel.

13. A refrigerated merchandiser having a cabinet with an open front product display area, primary air system means including evaporator cooling means constructed and arranged for refrigerating primary air to low refrigeration temperatures and primary air circulating means for circulating the refrigerated primary air from said evaporator cooling means to maintain a substantially uniform low temperature throughout the display area, said primary system means including a plurality of vertically spaced shelves, each of which is constructed and arranged to channel low temperature primary air therethrough and to discharge such air downwardly in a series of shelf-to-shelf primary air curtains immediately adjacent to the open front of the display area as part of the primary air circulating means, the primary air circulating means also discharging at least one other primary air curtain downwardly from the top of the merchandiser across the open front of the display area outwardly of the shelf-to-shelf primary air curtains, the air flow of said primary air curtains being the only positive air movement in said display area, and at least one other air system means constructed and arranged for forming another air curtain across the open front of the display area outwardly of said primary air curtains, said primary air system means having a normal display area refrigerating cycle in which said primary air curtains are downwardly formed at the open front of the display area, and defrost means for periodically defrosting the evaporator cooling means of said primary air system means including means for reversing the direction of said primary air circulation through the evaporator cooling means to thereby interrupt the formation of the downward primary air curtains, and in which the one other air system means comprises means for recirculating non-refrigerated air through the cabinet outwardly of said primary air system means to form a secondary air curtain, and maintaining said secondary air curtain across the open front of the display area during both the refrigerating and defrost cycles of the primary air system means.

14. The merchandiser of claim 13, which includes another air system means for discharging non-recirculated ambient air outwardly of said primary air system means to form a tertiary air curtain.

15. The merchandiser of claim 14, in which said another air system means comprises a tertiary air system for forming a non-recirculated tertiary curtain of ambient air across the open front outwardly of both the primary and secondary air curtains.

16. The merchandiser of claim 15, in which both of said secondary and tertiary air curtains are maintained across the open front during defrost cycles of the evaporator cooling means of said primary air system.

* * * * *